US010731432B2

(12) United States Patent
Machocki et al.

(10) Patent No.: US 10,731,432 B2
(45) Date of Patent: Aug. 4, 2020

(54) SYSTEMS AND METHODS FOR STUCK DRILL STRING MITIGATION

(71) Applicant: Aramco Overseas Company UK Ltd., Aberdeenshire (GB)

(72) Inventors: Krzysztof Karol Machocki, Aberdeen (GB); Michael Anthony Affleck, Aberdeen (GB)

(73) Assignee: SAUDI ARABIAN OIL COMPANY (SA)

( * ) Notice: Subject to any disclaimer, the term of this patent is extended or adjusted under 35 U.S.C. 154(b) by 0 days.

(21) Appl. No.: 16/425,427

(22) Filed: May 29, 2019

(65) Prior Publication Data

US 2019/0368295 A1 Dec. 5, 2019

Related U.S. Application Data

(60) Provisional application No. 62/678,040, filed on May 30, 2018.

(51) Int. Cl.
*E21B 31/113* (2006.01)
*E21B 17/06* (2006.01)

(52) U.S. Cl.
CPC ..... *E21B 31/113* (2013.01); *E21B 17/06* (2013.01)

(58) Field of Classification Search
CPC ..... E21B 31/113; E21B 17/06
See application file for complete search history.

(56) References Cited

U.S. PATENT DOCUMENTS 4,958,691 A * 9/1990 Hipp ..... E21B 4/14 175/296
5,139,086 A 8/1992 Griffith, Sr.
(Continued)

FOREIGN PATENT DOCUMENTS

WO 2017118858 A1 7/2017

OTHER PUBLICATIONS

International Search Report and Written Opinion for related PCT application PCT/US2019/034681 dated Nov. 27, 2019.
(Continued)

*Primary Examiner* — D. Andrews
(74) *Attorney, Agent, or Firm* — Bracewell LLP; Constance Gall Rhebergen

(57) ABSTRACT

Systems and methods for moving a tubular string within a subterranean well include a downhole assembly. The downhole assembly includes a torque disconnecting member and a shock generating member. During normal drilling activities, both components are inactive. When a stuck pipe event occurs, first the torque disconnecting member is activated while the shock generating member is still inactive. Once the torque disconnecting member is activated, then the shock generating member is activated. A laterally-protruding shock pad of the activated shock generating member produces shocks against the proximate side of a wellbore wall while the shock generating member is rotating. Systems and methods for moving a tubular string within a subterranean well include a fishing assembly. The fishing assembly includes a fishing member, a swivel member, and an imbalanced member. The imbalanced member has a cross-sectional center of gravity off-centered relative to the longitudinal axis to produce shocks against the proximate side of the wellbore wall while the imbalanced member is rotating.

18 Claims, 7 Drawing Sheets

(56) References Cited

U.S. PATENT DOCUMENTS

| | | | | |
|---|---|---|---|---|
| 5,323,853 | A | 6/1994 | Leismer et al. | |
| 5,515,922 | A | 5/1996 | Ruttley | |
| 6,082,457 | A | 7/2000 | Best et al. | |
| 6,328,101 | B1 | 12/2001 | Friis | |
| 6,732,817 | B2 | 5/2004 | Dewey et al. | |
| 7,025,130 | B2 | 4/2006 | Bailey et al. | |
| 7,299,885 | B2 | 11/2007 | Baird | |
| 7,395,862 | B2 | 7/2008 | Ross et al. | |
| 8,464,788 | B2 | 6/2013 | Stanford | |
| 8,936,076 | B2 | 1/2015 | Xu et al. | |
| 9,605,494 | B2 | 3/2017 | Hanton et al. | |
| 2012/0247757 | A1 | 10/2012 | Swinford | |
| 2017/0044843 | A1 | 2/2017 | Hanton et al. | |
| 2017/0044846 | A1 | 2/2017 | Hanton et al. | |
| 2018/0283123 | A1* | 10/2018 | Baudoin | E21B 31/1135 |

OTHER PUBLICATIONS

Partial ISRWO Invitation to pay additional fees and, where applicable, protest fees dated Aug. 23, 2019.

Brett, et al., "Bit Whirl—A New Theory of PDC Bit Failure," SPE 19571, 1989.

Vandiver, et al.,"Case Studies of the Bending Vibration and whirling Motion of Drill Collars," SPE 18652, 1989.

Ashley, et al., 2001. Extending BHALife with Multi-Axis Vibration Measurements. Paper SPE 67696 presented at the SPE/IADC Drilling Conference, Amsterdam, Feb. 27-Mar. 1.

* cited by examiner

SYSTEMS AND METHODS FOR STUCK DRILL STRING MITIGATION

RELATED APPLICATION

The disclosure is related to, and claims priority from, U.S. Provisional Patent Application 62/678,040, filed on May 30, 2018, the disclosure of which is incorporated herein by reference in its entirety.

BACKGROUND

1. Field

The disclosure relates generally to hydrocarbon development operations in a subterranean well, and more particularly to moving tubular members within a subterranean well during hydrocarbon development operations.

2. Description of the Related Art

Drilling operations possess a risk of encountering stuck pipe events. When a stuck pipe event occurs, the tubular string becomes difficult to move both in the axial direction and in the rotational direction.

A stuck pipe within a subterranean well is a cause of lost time during drilling and completion operations, especially in deviated and horizontal wells. Problems resulting from a stuck pipe can range from incidents causing an increase in costs to incidents where it takes days to get the pipe unstuck. In extreme cases where the problem cannot be resolved, the bore may have to be plugged and abandoned. Some bottom hole assemblies left plugged and abandoned may have radioactive substances or lithium power sources creating environmental risks. In addition, contact between the tubular string and the inner surface of the subterranean well even before the pipe becomes stuck can cause wear and damage to the tubular string. The tubular string can be, for example, a drill string, a casing string, or another elongated member lowered into the subterranean well.

Stuck pipe events may occur by differential sticking. To free a differentially stuck pipe, hydrostatic pressure can be reduced in the annulus allowing the pipe to be pushed out of the formation. However, the reduction of hydrostatic pressure may lead to a hydrocarbon influx into the wellbore, commonly known as a kick. Improper control of the kick may lead to hydrocarbons leaking out to the surface creating a hazard.

Jars or jar accelerators are used in the art to free stuck pipes by providing axial jarring movements. Tensile shocks are transmitted through the tubular string to free the stuck pipe. However, jarring operations are not always successful. Jars are prone to failure because their internal seals are likely to wear out as a result of multiple cycles of cocking or firing jars.

Downhole disconnect tools are used in the art in stuck pipe events by disconnecting the downhole section of the tubular string connected downhole of the tool. Once the downhole section is disconnected, torque, tension load, or hydraulic pressure can no longer be transmitted to the components downhole of the downhole disconnect tool. While the upper section of the tubular string can be pulled out to the surface, the downhole section is left in the wellbore. The stuck downhole section may be permanently left as is, or a subsequent fishing operation may be conducted in an attempt to pull the downhole section out.

SUMMARY

The disclosure relates to systems and methods for moving a tubular string within a wellbore during a stuck pipe event including a downhole assembly. The downhole assembly includes a torque disconnecting member and a shock generating member. During normal drilling activities, the torque disconnecting member is in a locking position and the shock generating member is in a deactivated position. When a stuck pipe event occurs, first the torque disconnecting member is unlocked while the shock generating member is still deactivated. Once the torque disconnecting member is unlocked, then the shock generating member is activated. A laterally-protruding shock pad of the activated shock generating member produces shocks against a proximate side of a wellbore wall while the shock generating member is rotating.

The disclosure relates to systems and method for moving a tubular string within a wellbore during a stuck pipe event including a fishing assembly. The fishing assembly includes a fishing member, a swivel member, and an imbalanced member. The imbalanced member has a cross-sectional center of gravity off-centered relative to the longitudinal axis to produce shocks against the proximate side of the wellbore wall while the imbalanced member is rotating.

The disclosure provides a system for moving a tubular string within a wellbore during a stuck pipe event. The system includes a torque disconnecting member. The torque disconnecting member includes a first mandrel and a first housing. The first mandrel is coupled to the first housing and is movable axially relative to the first housing. The first mandrel is rotationally coupled to the first housing in a locking position and the first mandrel is rotative relative to the first housing in an unlocking position. The system also includes a shock generating member. The shock generating member is coupled to the torque disconnecting member and includes a second mandrel, a second housing, and a shock pad. The second housing is rotationally coupled to the first mandrel. The second mandrel is coupled to the second housing, is movable axially relative to the second housing, and is further coupled to the shock pad. The second mandrel engages the shock pad to extend outwardly laterally in an activated position from a deactivated position. The deactivated position has the shock pad retracted inside the second housing.

In some embodiments, the torque disconnecting member further includes a locking mechanism. The locking mechanism includes a shear pin where the shear pin is configured to rotationally couple the first mandrel and the first housing in the locking position. In some embodiments, the locking mechanism further includes a first ball seat. A first ball is positioned on the first ball seat while downward hydraulic pressure is applied through the torque disconnecting member. Downward hydraulic pressure is applied to shear the shear pin and to disengage the first mandrel from the locking mechanism.

In some embodiments, the first mandrel includes a mandrel tension profile. The first housing includes a housing tension profile. The housing tension profile corresponds to the mandrel tension profile. The housing tension profile is configured to limit upward axial movement of the first mandrel relative to the first housing as upward tension force is applied to the first mandrel. The torque disconnecting member is maintained in the locking position. The mandrel tension profile and the housing tension profile are operable to transmit upward tension force from the first mandrel to the first housing. In some embodiments, the mandrel tension profile is collapsible allowing the mandrel tension profile to upwardly axially squeeze and pass through the housing tension profile. The torque disconnecting member can be switched to the unlocking position.

In some embodiments, the first mandrel includes a mandrel torque transmission profile section. The mandrel torque transmission profile section has a polygonal cross-section. The first housing includes a housing torque transmission profile section. The housing torque transmission profile section has a polygonal cross-section corresponding to the mandrel torque transmission profile section. When engaged, the mandrel torque transmission profile section and the housing torque transmission profile section rotationally couple the first mandrel and the first housing in the locking position. The mandrel torque transmission profile section and the housing torque transmission profile section are disengaged when the first mandrel moves upwardly axially relative to the first housing until the polygonal cross-sections are no longer in contact. The torque disconnecting member can be switched to the unlocking position. In some embodiments, the first mandrel includes a mandrel stop profile. The first housing includes a housing stop profile corresponding to the mandrel stop profile. The mandrel stop profile and the housing stop profile limit upward axial movement of the first mandrel relative to the first housing in the unlocking position. Upward tension force can be transmitted from the first mandrel to the first housing.

In some embodiments, the shock generating member further includes a spring. The spring engages with the second mandrel and the second housing. The spring is operable to maintain the deactivated position due to elastic force. The shock generating member further includes a second ball seat. A second ball is positioned on the second ball seat while applying downward hydraulic pressure through the shock generating member. Downward hydraulic pressure is applied to move the second mandrel downwardly axially relative to the second housing. The shock generating member can be switched to the activated position.

In some embodiments, the shock pad in the activated position has a graduate elevation face and a steep elevation face. The graduate elevation face is configured to contact a proximate side of a wellbore wall during rotation of the shock generating member. As the shock generating member is rotating, the graduate elevation face laterally lifts away the shock generating member from the contacting proximate side of the wellbore wall. As the shock generating member continues to rotate, the shock generating member laterally drops onto the proximate side of the wellbore wall generating a shock when the graduate elevation face is no longer contacting the proximate side of the wellbore.

In some embodiments, the second mandrel and the shock pad include corresponding activation profiles that limit outward lateral movement of the shock pad relative to the second housing in the activated position.

The disclosure also provides a method for moving a tubular string within a wellbore during a stuck pipe event. The method includes the step of unlocking a torque disconnecting member where the torque disconnecting member includes a first mandrel and a first housing. The first mandrel is coupled to the first housing and is movable axially relative to the first housing. The first mandrel is rotative relative to the first housing from a locking position. The locking position has the first mandrel rotationally coupled with the first housing. The method also includes the step of activating a shock generating member where the shock generating member is coupled to the torque disconnecting member. The torque disconnecting member includes a second mandrel, a second housing, and a shock pad. The second housing is rotationally coupled to the first mandrel, where the second mandrel is coupled to the second housing and is movable axially relative to the second housing. The second mandrel is coupled to the shock pad and engages the shock pad to extend outwardly laterally from a deactivated position. The deactivated position has the shock pad retracted inside the second housing.

In some embodiments, in the unlocking step, the torque disconnecting member further includes a locking mechanism including a shear pin. The shear pin rotationally couples the first mandrel and the first housing in the locking position. In some embodiments, the locking mechanism further includes a first ball seat. A first ball is positioned on the first ball seat. Downward hydraulic pressure is applied through the torque disconnecting member to shear the shear pin and to disengage the first mandrel from the locking mechanism.

In some embodiments, in the unlocking step, the first mandrel includes a mandrel tension profile and the first housing includes a housing tension profile corresponding to the mandrel tension profile. The mandrel tension profile and the housing tension profile limit upward axial movement of the first mandrel relative to the first housing as upward tension force is applied to the first mandrel. The mandrel tension profile and the housing tension profile transmit upward tension force from the first mandrel to the first housing. In some embodiments, the mandrel tension profile is collapsible allowing the mandrel tension profile to upwardly axially squeeze and pass through the housing tension profile. The torque disconnecting member can be switched to the unlocking position.

In some embodiments, in the unlocking step, the first mandrel includes a mandrel torque transmission profile section. The mandrel torque transmission profile section has a polygonal cross-section. The first housing includes a housing torque transmission profile section. The housing torque transmission profile section has a polygonal cross-section corresponding to the mandrel torque transmission profile section. When engaged, the mandrel torque transmission profile section and the housing torque transmission profile section rotationally couple the first mandrel and the first housing in the locking position. The mandrel torque transmission profile section and the housing torque transmission profile section are disengaged when the first mandrel moves upwardly axially relative to the first housing until the polygonal cross-sections are no longer in contact. The torque disconnecting member can be switched to the unlocking position. In some embodiments, the first mandrel includes a mandrel stop profile. The first housing includes a housing stop profile corresponding to the mandrel stop profile. The mandrel stop profile and the housing stop profile limit upward axial movement of the first mandrel relative to the first housing as the torque disconnecting member is unlocked. Upward tension force can be transmitted from the first mandrel to the first housing.

In some embodiments, in the activating step, the shock generating member further includes a spring. The spring engages with the second mandrel and the second housing. The spring is operable to maintain the deactivated position due to elastic force. The shock generating member further includes a second ball seat. A second ball is positioned on the second ball seat. Downward hydraulic pressure is applied through the shock generating member to move the second mandrel downwardly axially relative to the second housing.

In some embodiments, the method further includes the step of rotating the activated shock generating member to generate a shock. The shock pad has a graduate elevation face and a steep elevation face. The graduate elevation face contacts a proximate side of a wellbore wall as the activated shock generating member is rotating. As the shock generating member is rotating, the graduate elevation face laterally lifts away the shock generating member from the contacting proximate side of the wellbore wall. As the rotating shock generating member continues to rotate, the shock generating member laterally drops onto the proximate side of the wellbore wall when the graduate elevation face is no longer contacting the proximate side of the wellbore.

In some embodiments, in the activating step, the second mandrel and the shock pad include corresponding activation profiles limiting outward lateral movement of the shock pad relative to the second housing.

The disclosure also provides a system for moving a tubular string within a wellbore during a stuck pipe event. The system includes a fishing member. The fishing member is operable to engage a stuck pipe. The system also includes a swivel member and an imbalanced member. The imbalanced member has a cross-sectional center of gravity off-centered relative to the longitudinal axis.

In some embodiments, the fishing member is coupled to a downhole swivel housing of a swivel member and the imbalanced member is rotationally coupled to an uphole swivel housing of the swivel member such that the uphole swivel housing and the imbalanced member are rotative relative to the downhole swivel housing and the fishing member. In some embodiments, the swivel member includes at least one bearing. In some embodiments, the swivel member includes a tension transmission profile operable to transmit tension force from uphole swivel housing to the downhole swivel housing.

In some embodiments, the fishing member includes a catching surface to engage an exterior of the stuck pipe. In some embodiments, the imbalanced member is configured to generate a shock against a proximate side of a wellbore wall as the imbalanced member is rotating.

The disclosure also provides a method for moving a tubular string within a wellbore during a stuck pipe event. The method includes the step of engaging a stuck pipe with a fishing member. The method includes the step of rotating an imbalanced member to generate a shock against a proximate side of a wellbore wall. The imbalanced member has a cross-sectional center of gravity off-centered relative to the longitudinal axis.

In some embodiments, the fishing member is coupled to a downhole swivel housing of a swivel member and the imbalanced member is rotationally coupled to an uphole swivel housing of the swivel member such that the uphole swivel housing and the imbalanced member are rotative relative to the downhole swivel housing and the fishing member. In some embodiments, the swivel member includes at least one bearing. In some embodiments, the swivel member includes a tension transmission profile operable to transmit tension force from uphole swivel housing to the downhole swivel housing.

In some embodiments, the fishing member includes a catching surface to engage an exterior of the stuck pipe. In some embodiments, the method further includes the step of severing the stuck pipe uphole a stuck point. In some embodiments, the method further includes the step of retrieving the stuck pipe.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

Figure 1:
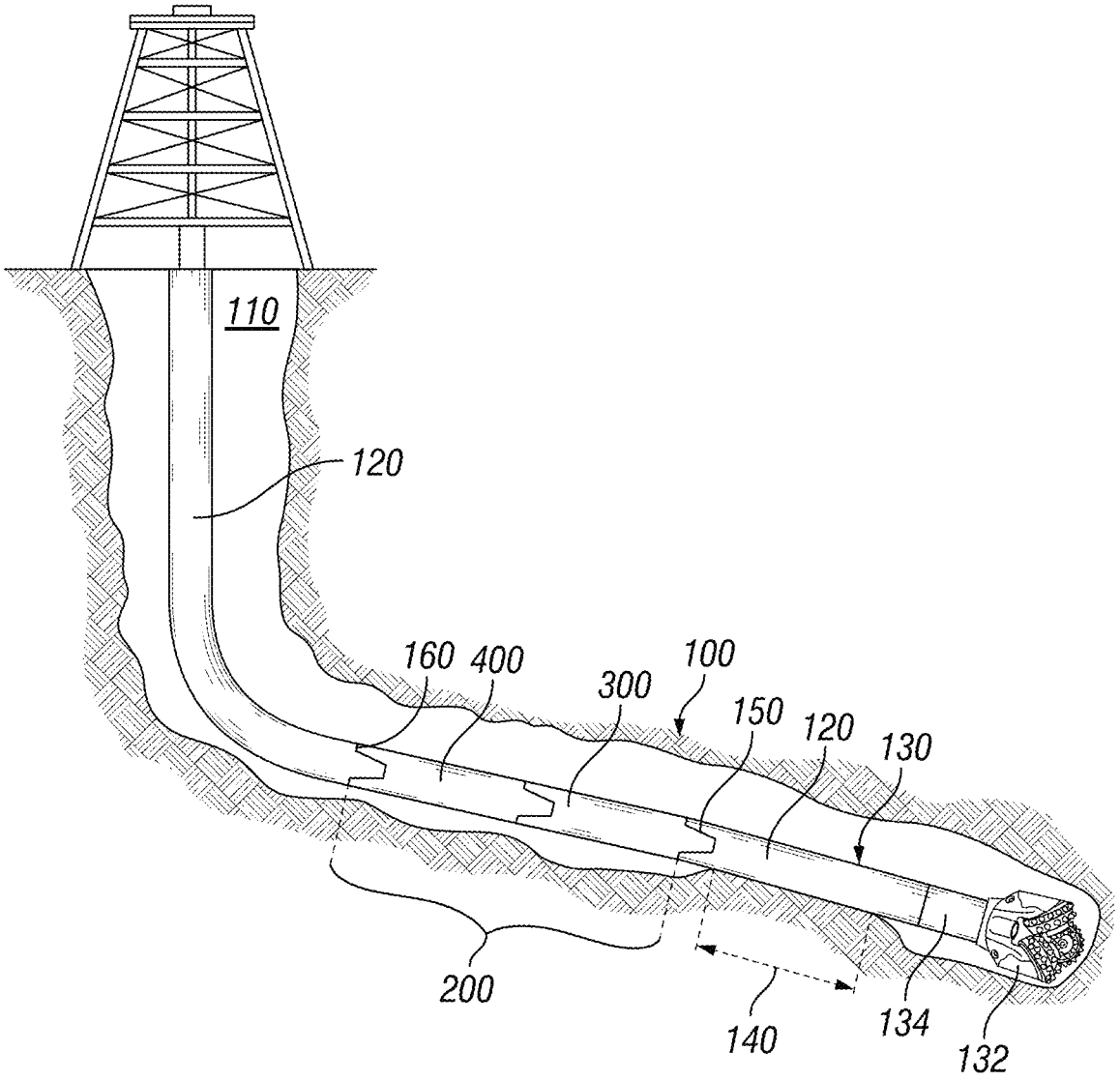
FIG. 1 is a schematic sectional representation of a subterranean well having a downhole assembly, in accordance with an embodiment of this disclosure.

The disclosure refers to particular features, including process or method steps. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise. Like numbers refer to like elements throughout the disclosure.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms describe the relative position of an object or a group of objects relative to another object or group of objects. The spatial relationships apply along vertical and horizontal axes. Orientation and relational words, including "uphole," "downhole," "upward," "downward," and other like terms, are for descriptive convenience and are not limiting unless otherwise indicated.

Referring to FIG. 1, a subterranean well 100 extends downwards from a surface of the earth, which can be a ground level surface or a subsea surface. A wellbore 110 of the subterranean well can be extended generally vertically relative to the surface. The wellbore 110 can alternately include portions that extend generally horizontally or in other directions that deviate from generally vertically from the surface. The subterranean well 100 can be a well associated with hydrocarbon development operations, such as a hydrocarbon production well, an injection well, or a water well.

A tubular string 120 extends into the wellbore 110 of subterranean well 100. The tubular string 120 can be, for example, a drill string, a casing string, or another elongated member lowered into the subterranean well 100. The wellbore 110 can be an uncased opening. In embodiments where tubular string is an inner tubular member, the wellbore 110 can be part of an outer tubular member, such as a casing.

The tubular string 120 can include downhole tools and equipment that are secured in line with joints of the tubular string 120. The tubular string 120 can have, for example, a bottom hole assembly 130 that can include a drilling bit 132 and logging while drilling tools 134. The drilling bit 132 can rotate to create the wellbore 110 of the subterranean well 100. Logging while drilling tools 134 can be used to measure properties of the formation adjacent to subterranean well 100 as the wellbore 110 is being drilled. The logging while drilling tools 134 can also include measurement while drilling tools that can gather data regarding conditions of and within the wellbore 110, such as the azimuth and inclination of the wellbore 110.

As the tubular string 120 moves through the wellbore 110, there may be times when the tubular string 120 is at risk of becoming stuck or does become stuck. The risk of becoming stuck increases, for example, in wellbores 110 with an uneven inner surface or wellbores 110 that have a change in direction. A non-limiting example of a stuck point or stuck section 140 (collectively referred to as "stuck point") is shown in FIG. 1, where the tubular string 120 is unable to move both in the axial direction and in the rotational direction. At the stuck point 140, the tubular string 120 makes contact with the inner surface of the wellbore 110. In some embodiments, the stuck point 140 is caused by differential sticking.

The downhole assembly 200 is placed in a position within or axially uphole from the bottom hole assembly 130 just uphole of a potential stuck point 140. Tubular strings 120 are connected both downhole and uphole the downhole assembly 200 via connections 150, 160. The downhole assembly 200 includes a torque disconnecting member 300 and a shock generating member 400. The shock generating member 400 is positioned uphole of the torque disconnecting member 300. The shock generating member 400 is coupled to the torque disconnecting member 300 typically using standard American Petroleum Institute (API) connections known in the art.

The position of the downhole assembly 200 within the tubular string 120 can be calculated using well planning software for predicting a possible trouble zone. The position of the downhole assembly 200 can be calculated using vibration study software for predicting where the downhole assembly 200 placement in a given tubular string 120 will provide the greatest impact when attempting to free a stuck pipe. The position of the downhole assembly 200 can also be estimated by field experience or by using historical data collected from similar stuck pipe events of other wells.

Figure 2A:
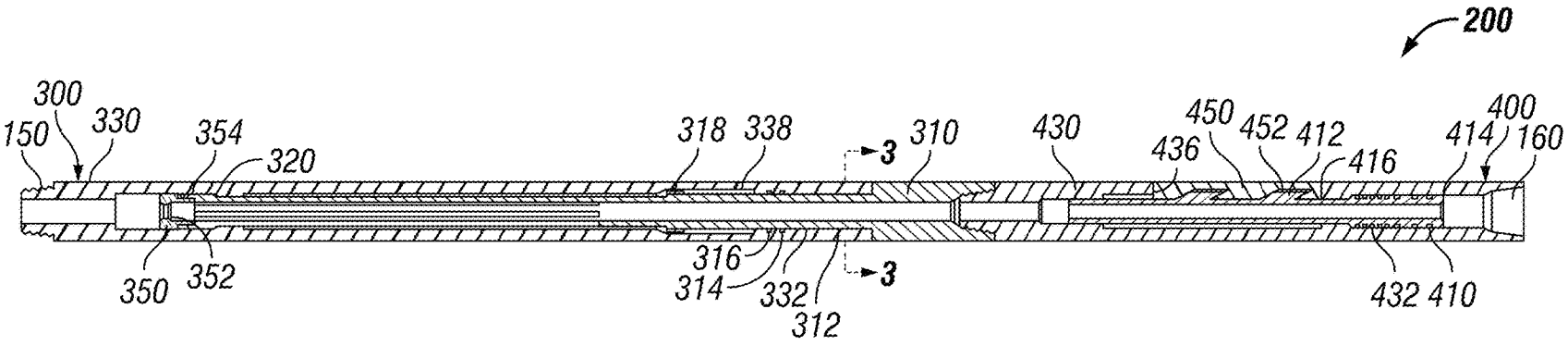
FIG. 2A is a side cross-sectional view of the downhole assembly, in accordance with an embodiment of this disclosure. The torque disconnecting member is in a locked position and the shock generating member is in a deactivated position.

Referring to FIG. 2A, the torque disconnecting member 300 is in a locked position and the shock generating member 400 is in a deactivated position. The torque disconnecting member 300 includes a first mandrel 310 coupled to a first housing 330. The first mandrel 310 and the first housing 330 are coupled via a locking mechanism 350. The locking mechanism 350 can include a first ball seat 352. The locking mechanism 350 can include at least one shear pin 354, where the shear pin 354 engages the first mandrel 310 and the locking mechanism 350. While the torque disconnecting member 300 is in the locked position, the shear pin 354 via the locking mechanism 350 limits axial movement of the first mandrel 310 relative to the first housing 330. The locking mechanism 350 can be disengaged by shearing the shear pin 354. When the locking mechanism 350 is disengaged, the first mandrel 310 becomes free to move axially relative to the first housing 330.

Figure 2B:
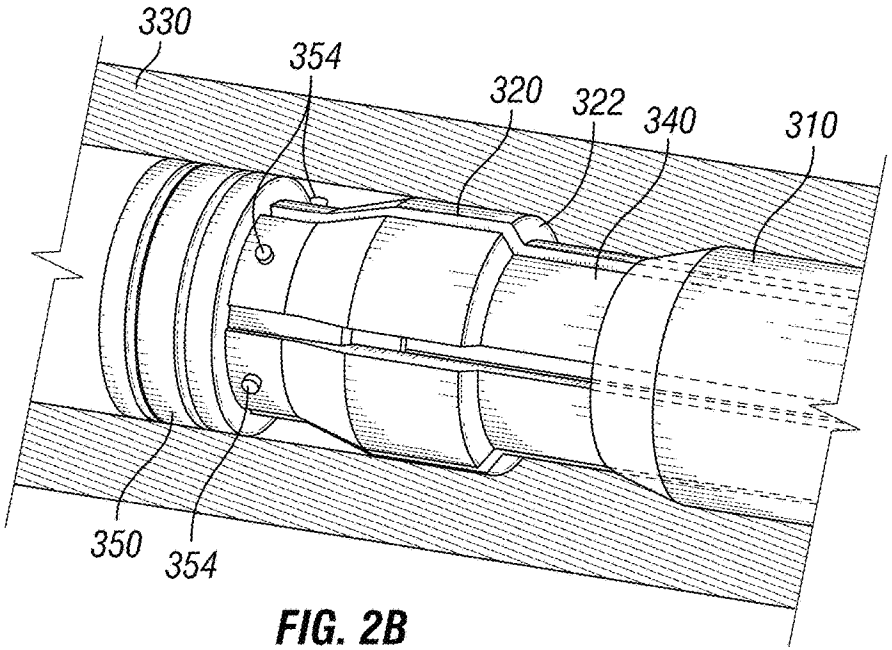
FIG. 2B is an enlarged perspective view of the torque disconnecting member in the locked position.

Referring to FIG. 2B, one or more shear pins 354 are engaging both the first mandrel 310 and the locking mechanism 350. The shear pin 354 is securedly positioned by means known in the art. The first mandrel 310 includes a mandrel tension profile 320 and a collapsible tension profile 322. In the locked position, the engaged shear pin 354 prevents the collapsible tension profile 322 from moving away from the locking mechanism 350. When the shear pin 354 is engaged, the mandrel tension profile 320 is in contact with a downhole surface of a housing tension profile 340 of the first housing 330. When the shear pin 354 is engaged, the collapsible tension profile 322 is not configured to collapse, restricting uphole axial movement of the first mandrel 310 due to the mandrel tension profile 320 contacting the housing tension profile 340. As the collapsible tension profile 322 is engaged with the housing tension profile 340, uphole tension force can be transmitted from the first mandrel 310 to the first housing 330.

Referring back to FIG. 2A, in the locked position, torque is transmitted from the surface using surface torque equipment (not shown) downwards through an upper tubular string 120 and further downwards through the first mandrel 310. Torque is transmitted further downwards from the torque disconnecting member 300 to a lower tubular string 120 and a bottom hole assembly 130 via a downhole connection 150 (see FIG. 1). The downhole connection 150 can include API threads commonly used in drilling equipment.

The first mandrel 310 includes a mandrel torque transmission profile section 312. The first housing 330 includes a housing torque transmission profile section 332. The mandrel torque transmission profile section 312 of the first mandrel 310 matches the corresponding housing torque transmission profile section 332 of the first housing 330. In some embodiments, the corresponding torque transmission profile sections 312, 332 have matching polygonal cross-sections, preferably hexagonal cross-sections. In other embodiments, the corresponding torque transmission profile sections 312, 332 can have any matching shapes capable of transmitting torque and moving axially. Still in other embodiments, the corresponding torque transmission profile sections 312, 332 can include constant-velocity (CV) joints, and single or multiple keys for hydraulic or electromechanical motor torque transmission.

Figure 3:
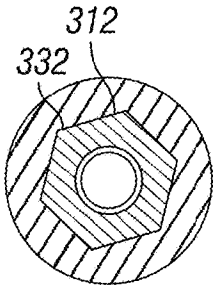
FIG. 3 is a front cross-sectional view of the torque disconnecting member shown in FIG. 1, taken along line 3-3.

Referring to FIG. 3, a front cross-sectional view of the torque disconnecting member 300 in the locked position is shown. The mandrel torque transmission profile section 312 of the first mandrel 310 matches and engages the corresponding housing torque transmission profile section 332 of the first housing 330. During normal drilling activities, the torque disconnecting member 300 is kept in the locked position where torque is transmitted from the surface through the downhole assembly 200 to the bottom hole assembly 130. The corresponding torque transmission profile sections 312, 332 have matching polygonal cross-sections. In some embodiments, the corresponding torque transmission profile sections 312, 332 have matching hexagonal cross-sections. Other torque transmitting techniques can be used such as locking dogs or locking keys known in the art.

Referring back to FIG. 2A, seals 314, 316 are engaged on the cylindrical surface of the first mandrel 310 to maintain hydraulic pressure integrity of the tubular string 120. Seals 314, 316 can be located proximate to the mandrel torque transmission profile section 312. More than one seals 314, 316 are typically used in the downhole assembly 200 for backup in case one results in failure.

The first mandrel 310 includes a first mandrel stop profile 318. The first housing 330 includes a first housing stop profile 338 having a cross-sectional block shape. The first mandrel stop profile 318 of the first mandrel 310 matches the corresponding first housing stop profile 338 of the first housing 330. The first housing stop profile 338 is a hard stop against the first mandrel stop profile 318 and would not allow the first mandrel 310 to move uphole axially beyond that point. When the locking mechanism 350 is disengaged, the first mandrel 310 becomes free to move upwardly axially relative to the first housing 330 until the first mandrel stop profile 318 contacts the first housing stop profile 338.

The shock generating member 400 includes a second mandrel 410 coupled to a second housing 430. Torque is transmitted from the surface using surface torque equipment (not shown) downwards through an upper tubular string 120 and further downwards through the second housing 430 via an uphole connection 160. The uphole connection 160 can include API threads commonly used in drilling equipment. Torque is transmitted through the second housing 430 to the torque disconnecting member 300. The shock generating member 400 is coupled to the first mandrel 310 of the torque disconnecting member 300 typically using standard API connections known in the art.

The shock generating member 400 includes a shock pad 450. In the deactivated position, the shock pad 450 is positioned inside the second housing 430 in a pocket and does not protrude radially outward beyond the cylindrical surface of the second housing 430. The second mandrel 410 includes at least one mandrel activation profile 412 that matches a corresponding shock pad activation profile 452 of the shock pad 450. The shock generating member 400 includes a second ball seat 414 and a spring 432. In some embodiments, the shock pad 450 can extend outwardly laterally until the shock pad 450 reaches a second housing stop profile 436 of the second housing 430 and is secured by a corresponding second mandrel stop profile 416 of the second mandrel 410. In other embodiments, either the second mandrel 410 or the shock pad 450 include other means known in the art to restrict the lateral movement of the shock pad 450. Still in other embodiments, the shock pad 450 includes a base (not shown) occupying an area greater than the cylindrical area of the shock pad 450 pocket, where the shock pad 450 can be assembled from within the second housing 430. Yet in other embodiments, the downward axial movement of the second mandrel 410 can be restricted to set a limit to the lateral movement of the shock pad 450.

During normal drilling activities where the tubular string 120 rotates freely, the shock generating member 400 is maintained in the deactivated position rotating freely where the shock pad 450 is retracted inside the second housing 430. As the shock pad 450 is in the retracted position, the downhole assembly 200 is rotating smoothly against the wellbore 110 bed side for deviated wells. Vibrations or shocks are not generated when the shock generating member 400 is in the deactivated position.

Figure 4A:
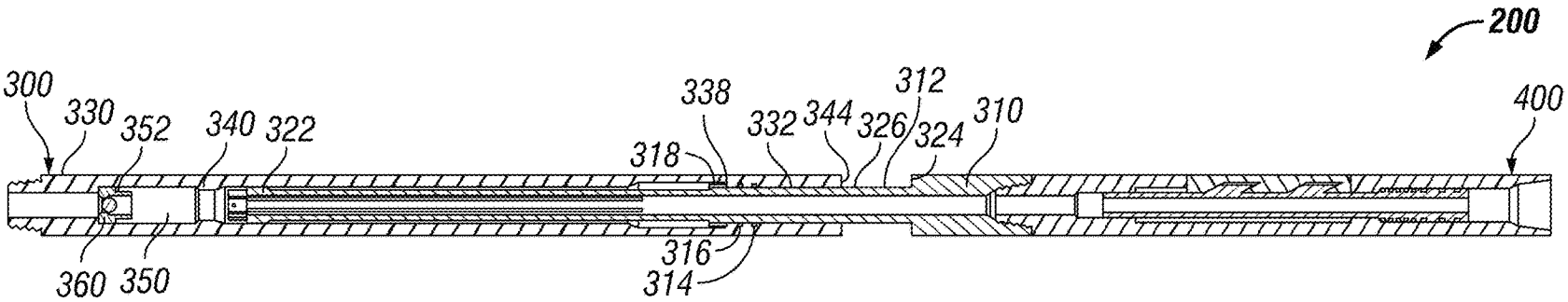
FIG. 4A is a side cross-sectional view of the downhole assembly, in accordance with an embodiment of this disclosure. The torque disconnecting member is in an unlocked position and the shock generating member is in the deactivated position.

Referring now to FIG. 4A, the torque disconnecting member 300 is in an unlocked position and the shock generating member 400 is still in the deactivated position. When a stuck pipe event occurs and subsequent jarring events fail to free the tubular string 120, the torque disconnecting member 300 is set to the unlocked position. Unlocking the torque disconnecting member 300 allows torque to be continuously applied from the surface and to be transmitted to the shock generating member 400 while the first housing 330 is kept stationary due to the stuck pipe event.

In some embodiments, the torque disconnecting member 300 is unlocked by dropping a first ball 360 inside the tubular string 120 from the surface onto the first ball seat 352. As the first ball 360 is dropped and positioned on the first ball seat 352, the shear pin 354 is sheared. Downward hydraulic pressure can also be applied to shear the shear pin 354. Other methods known in the art can be applied to shear the shear pin 354.

Figure 4B:
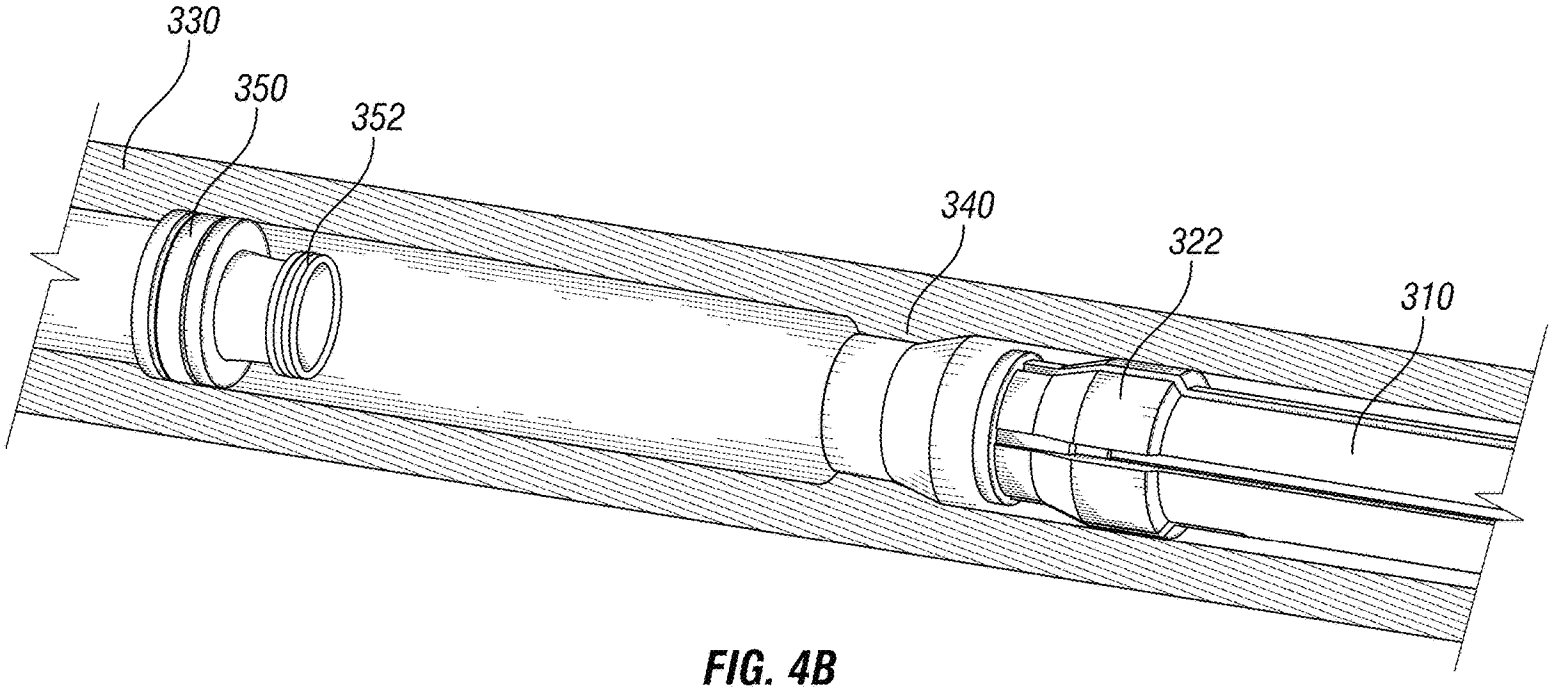
FIG. 4B is an enlarged perspective view of the torque disconnecting member in the unlocked position.

Referring to FIG. 4B, the locking mechanism 350 is disengaged from the first mandrel 310 after the shear pin 354 is sheared. In the locked position, the locking mechanism 350 is engaged with the first mandrel 310 and prevents the collapsible tension profile 322 from squeezing and passing through the housing tension profile 340 of the first housing 330. However, once the shear pin 354 is sheared by positioning the first ball 360 on the first ball seat 352 and by applying downward hydraulic pressure, the locking mechanism 350 disengages from the first mandrel 310 and move downwardly axially, allowing the collapsible tension profile 322 to be capable of collapsing. When uphole tension force is applied, the collapsible tension profile 322 squeezes and passes through the housing tension profile 340. Once the collapsible tension profile 322 completely passes through the housing tension profile 340, the collapsible tension profile 322 and the housing tension profile 340 are disengaged.

Referring back to FIG. 4A, as the locking mechanism 350 and the first mandrel 310 are disengaged, the first mandrel 310 becomes freely rotatable and axially movable relative to the first housing 330. However, once the locking mechanism 350 and the first mandrel 310 are disengaged, uphole tension force may not be transferred from the first mandrel 310 to the first housing 330 until the first mandrel 310 travels sufficiently uphole to allow the first mandrel stop profile 318 to reach and engage the first housing stop profile 338. As the corresponding tension profiles 318, 338 are engaged, tension load can be transmitted from the surface through the first mandrel 310 and through the first housing 330 to components connected downhole of the downhole assembly 200. As the shear pin 354 is sheared, some debris of the shear pin 354 would be kept inside the first mandrel 310 and other debris of the shear pin 354 would be kept in vacancies created by the locking mechanism 350, the first mandrel 310, and the first housing 330. In some embodiments, fluid circulation can be resumed downhole to the bottom hole assembly 130 after shearing the shear pin 354.

The first ball 360 includes materials such as steel, plastic, polyurethane, magnesium, or manganese. In some embodiments, the first ball 360 includes, for example, plastic or polyurethane to be sheared after the torque disconnecting member 300 is unlocked. In other embodiments, the first ball 360 includes, for example, magnesium to be dissolved after the torque disconnecting member 300 is unlocked. The first ball 360 can have various sizes suitable to pass through the inside diameter of the tubular string 120 and to land on the first ball seat 352. Hydraulic pressure can be applied while dropping the first ball 360. The first ball 360 is pumped down inside the tubular string 120 utilizing fluid flow and gravity. There can be no increase in downward hydraulic pressure while the first ball 360 is pumped down inside the tubular string 120 until the first ball 360 is positioned onto the first ball seat 352. An operator may notice pressure increase once the first ball 360 is positioned on the first ball seat 352. Flow rates slower than normal drilling flow rates can be used when pumping down the first ball 360. In some embodiments, flow rates ranging from about 50 gallons per minute (GPM) to about 150 GPM are used to pump down the first ball 360, while the normal drilling flow rates range from about 350 GPM to about 800 GPM. In other embodiments, flow rates ranging from about 25 GPM to about 300 GPM are used to pump down the first ball 360. Once the first ball 360 is positioned on the first ball seat 352, downward hydraulic pressure can be applied. The first ball 360 positioned on the first ball seat 352 restricts fluid passage further downwards the downhole assembly 200. An incremental increase in flow rate can rapidly increase downward hydraulic pressure inside the tubular string 120.

In other embodiments, unlocking the torque disconnecting member 300 can be achieved by other methods known in the art, such as dropping a dart, dropping a ported dart, utilizing radio-frequency identification (RFID) tags, or providing pressure impulse from pumps located at the surface. Darts include rubber tails to assist in pumping the darts down the tubular string 120. Darts are typically used in non-vertical wells, preferably horizontal wells, when gravity becomes less a factor. RFID tags are microchips built inside a carrier, typically in forms of plastic spheres. The torque disconnecting member 300 can include a built-in electronic device including a power source, electronics, an electromechanical actuator, and a wireless receiver. The wireless receiver detects the RFID tag as the tag passes the receiver. As the tag is detected, the electronics subsequently respond and transmit signals to the electromechanical actuator to unlock or lock the torque disconnecting member 300.

To unlock the torque disconnecting member 300, upward tension is applied from the surface to axially upwardly pull out a portion of the first mandrel 310 from the first housing 330. The mandrel torque transmission profile section 312 of the first mandrel 310 and the corresponding housing torque transmission profile section 332 of the first housing 330 becomes decoupled. A mandrel compression face 324 of the first mandrel 310 is no longer in contact with a corresponding housing compression face 344 of the first housing 330. These corresponding compression faces 324, 344 are configured to transmit compression loads to and from components connected via the downhole connection 150 downhole of the downhole assembly 200 when the torque disconnecting member 300 is maintained in the locked position, allowing the entire tubular string 120 to rotate, move up and down, or be pressurized during normal drilling activities. When torque disconnecting member 300 is in the unlocked position, torque is no longer transmitted from the first mandrel 310 and components uphole of the first mandrel 310, to the first housing 330 and components connected downhole of. Uphole axial movement of the first mandrel 310 relative to the first housing 330 is physically stopped when the first mandrel stop profile 318 of the first mandrel 310 reaches the first housing stop profile 338 of the first housing 330. The first mandrel 310 is pulled out of the first housing 330 in an amount exceeding the entire length of the mandrel torque transmission profile section 312 until a cylindrical surface (not shown) of the first mandrel 310 is exposed. The entire length of the mandrel torque transmission profile section 312 is the distance between the mandrel compression face 324 and an end face 326. Although axial upward movement of the first mandrel 310 is no longer present relative to the first housing 330, upward tension is continuously applied from the surface and downward hydraulic pressure is maintained. Upward tension is transmitted to the torque disconnecting member 300 through the rotating first mandrel stop profile 318 of the first mandrel 310 and through the contacting stationary first housing stop profile 338 of the first housing 330. Friction can be reduced between the contacting stop profiles 318, 338 by utilizing materials such as brass or bearings such as roller or ball bearings.

In the unlocked position, seals 314, 316 are engaged between the first housing 330 and the first mandrel 310. The seals 314, 316 are configured to maintain hydraulic pressure integrity between interior and exterior of the tubular string 120. As in normal drilling activity, drilling mud can continue to be transferred from the surface through the first housing 330 downwards to the components of the bottom hole assembly 130 such as the drill bit 132. In the unlocked position, tensile integrity is maintained with components downhole the torque disconnecting member 300.

The status of the unlocking event is confirmed by the operator at the surface by applying torque to the tubular string 120 from the surface, by monitoring torque gauge, or by visually observing the tubular string 120 rotating. Once the operator confirms that the torque disconnecting member 300 is unlocked, the shock generating member 400 is activated.

Figure 5:
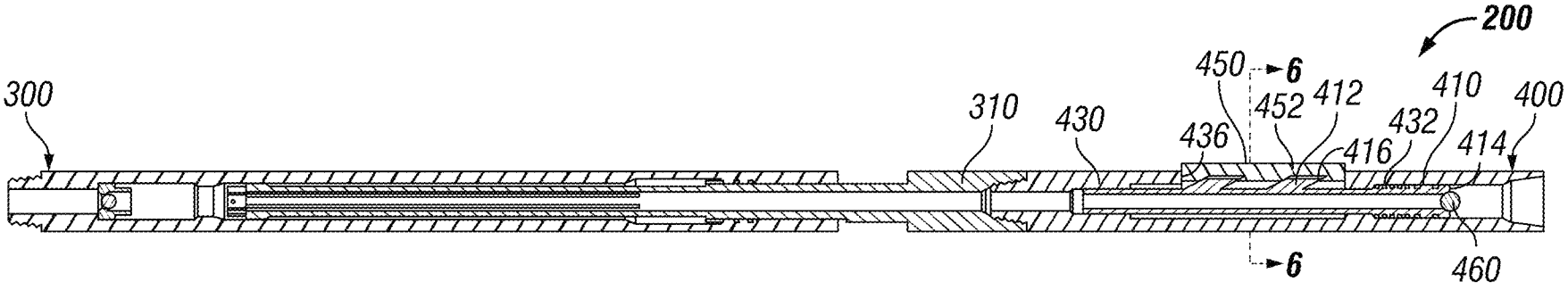
FIG. 5 is a side cross-sectional view of the downhole assembly, in accordance with an embodiment of this disclosure. The torque disconnecting member is in the unlocked position and the shock generating member is in an activated position.

Referring now to FIG. 5, the torque disconnecting member 300 is in the unlocked position and the shock generating member 400 is in an activated position. Applying torque to the shock generating member 400 in the activated position allows the downhole assembly 200 to generate shocks to free the stuck tubular string 120.

In some embodiments, shock generating member 400 is activated by dropping a second ball 460 inside the tubular string 120 from the surface onto the second ball seat 414. The second ball 460 includes materials such as steel, plastic, polyurethane, magnesium, or manganese. In some embodiments, the second ball 460 includes, for example, plastic or polyurethane to be sheared after the shock generating member 400 is activated. In other embodiments, the second ball 460 includes, for example, magnesium to be dissolved after the shock generating member 400 is activated. The second ball 460 can have various sizes suitable to pass through the inside diameter of the tubular string 120 and to land on the second ball seat 414. The second ball 460 is greater in size than the first ball 360. Hydraulic pressure can be applied while dropping the second ball 460. The second ball 460 is pumped down inside the tubular string 120 utilizing fluid flow and gravity. There may be no increase in downward hydraulic pressure while the second ball 460 is pumped down inside the tubular string 120 until the second ball 460 is positioned onto the second ball seat 414. The operator may notice pressure increase once the second ball 460 is positioned on the second ball seat 414. Flow rates slower than normal drilling flow rates can be used when pumping down the second ball 460. In some embodiments, flow rates ranging from about 50 GPM to about 150 GPM are used to pump down the second ball 460, while the normal drilling flow rates range from about 350 GPM to about 800 GPM. In other embodiments, flow rates ranging from about 25 GPM to about 300 GPM are used to pump down the second ball 460. Once the second ball 460 is positioned on the second ball seat 414, downward hydraulic pressure can be applied. The second ball 460 positioned on the second ball seat 414 restricts fluid passage further downwards the shock generating member 400. An incremental increase in flow rate can rapidly increase downward hydraulic pressure inside the tubular string 120. Downward hydraulic pressure on the second ball 460 and on the second mandrel 410 creates downward axial force and movement against the spring 432, where one end is fixed to the second mandrel 410 and the other end is fixed to the second housing 430. The downward axial movement of the second mandrel 410 exhibits a piston-like behavior where the off-angled at least one mandrel activation profile 412 pushes the corresponding off-angled at least one shock pad activation profile 452 to extend the shock pad 450 outwardly laterally from the second housing 430. In some embodiments, the spring 432 is compressed until the shock pad 450 reaches the second housing stop profile 436 of the second housing 430 and is secured by the corresponding second mandrel stop profile 416 of the second mandrel 410. In other embodiments, either the second mandrel 410 or the shock pad 450 include other means known in the art to restrict the lateral movement of the shock pad 450. Still in other embodiments, the shock pad 450 includes a base (not shown) occupying an area greater than the cylindrical area of the shock pad 450 pocket, where the shock pad 450 can be assembled from within the second housing 430. Yet in other embodiments, the downward axial movement of the second mandrel 410 can be restricted to set a limit to the lateral movement of the shock pad 450.

In other embodiments, activation of the shock generating member 400 can be achieved by other methods known in the art, such as dropping a dart, dropping a ported dart, utilizing RFID tags, or providing pressure impulse from pumps located at the surface. Darts include rubber tails to assist in pumping the darts down the tubular string 120. Darts are typically used in non-vertical wells, preferably horizontal wells, when gravity becomes less a factor. RFID tags are microchips built inside a carrier, typically in forms of plastic spheres. The shock generating member 400 can include a built-in electronic device including a power source, electronics, an electromechanical actuator, and a wireless receiver. The wireless receiver detects the RFID tag as the tag passes the receiver. As the tag is detected, the electronics subsequently respond and transmit signals to the electromechanical actuator to activate or deactivate the shock generating member 400.

Activation of the shock generating member 400 is performed while the first mandrel 310 of the torque disconnecting member 300 is rotating and while upward tension force is applied to the entire tubular string 120. Tension force is constantly applied to prevent the mandrel torque transmission profile section 312 of the first mandrel 310 from reengaging to the corresponding housing torque transmission profile section 332 of the first housing 330. Activation of the shock generating member 400 is operable to shift the cross-sectional center of gravity off-centered relative to the longitudinal axis.

Figure 6:
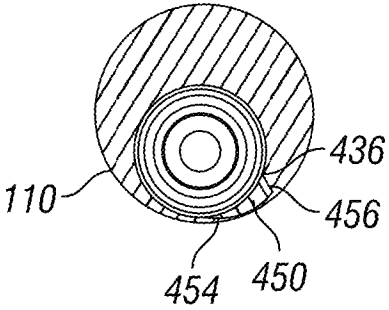
FIG. 6 is a front cross-sectional view of the shock generating member shown in FIG. 5, taken along line 6-6. The shock generating member is placed inside a wellbore.

Referring to FIG. 6, a front cross-sectional view of the shock generating member 400 in the activated position is shown. The shock generating member 400 is located inside the wellbore 110. The shock pad 450 is laterally extended out from the second housing 430 until the shock pad 450 reaches a limit, where the laterally protruding portion of the shock pad 450 include a graduate elevation face 454 and a steep elevation face 456. While the activated shock generating member 400 is rotating, for example clockwise shown in FIG. 6, the graduate elevation face 454 makes contact with a proximate wall of the wellbore 110. While the activated shock generating member 400 is rotating and the graduate elevation face 454 is contacting the wellbore 110, the graduate elevation face 454 generates a laterally lifting force against the proximate wall of the wellbore 110 laterally pushing away the downhole assembly 200 and components connected uphole and downhole from the proximate wall. Once the rotation forces the contacting wall to reach the end of the graduate elevation face 454, the shock generating member 400 laterally drops to the proximate wall because a gap appears immediately after the wall is no longer in contact with the graduate elevation face 454. The proximate wall makes minimal contact with the steep elevation face 456. The rapid lateral drop towards the earlier proximate wall of the wellbore 110 creates a shock to the tubular string 120. The activated shock pad 450 makes one contact with the wellbore 110 per rotation, creating one shock per rotation. In some embodiments, the magnitude of force generated by the activated shock pad 450 ranges from about 20 times gravitational force to about 30 times gravitational force. In other embodiments, the magnitude of force generated by the activated shock pad 450 ranges from about 10 times gravitational force to about 50 times gravitational force. Still in other embodiments, the magnitude of force generated by the activated shock pad 450 ranges from about 5 times gravitational force to about 100 times gravitational force. In some embodiments, the activated shock generating member 400 rotates in a rate ranging from about 60 revolutions per minute (RPM) to about 180 RPM. In other embodiments, the activated shock generating member 400 rotates in a rate ranging from about 30 RPM to about 360 RPM. Shocks generated by the activated shock generating member 400 travel away from the source in both axial directions: upward to the surface and downward to the bottom hole assembly 130. In some embodiments, these periodic shocks can resonate over the entire tubular string 120 such that at some distances away from the downhole assembly 200, more than one shock per rotation can be observed. Resonance frequency of the downhole assembly 200 can be calculated using software. In other embodiments, these periodic shocks can trigger the tubular string 120 to experience and exhibit conditions known as forward, backward, or chaotic whirls. Still in other embodiments, lateral forces ranging from about 30 times to about 40 times gravitational force can be observed near the stuck point 140. Yet in other embodiments, these periodic shocks generate vibratory forces that travel towards the stuck point 140. The downhole assembly 200 does not require fluid flow to generate shocks.

In an alternate embodiment, the shock generating member 400, in lieu of the laterally protruding shock pad 450, can incorporate components upon activation operable to shift the cross-sectional center of gravity off-centered relative to the longitudinal axis. While rotating, the shock generating member 400 having an off-centered center of gravity in the activated position can kick the proximate wellbore 110 wall generating shocks near the stuck point 140. The rate of rotation ranges from about 60 RPM to about 180 RPM. Such embodiment is shown for example in FIGS. 7 and 8.

Lateral force, as opposed to a longitudinal force such as jarring or pulling force, created by the shock generating member 400 applies directly against differentially stuck force that is laterally pushing the pipe to make contact with the proximate wellbore 110 wall at the stuck point 140. Friction between the tubular string 120 and the wellbore 110 wall at the stuck point 140 becomes less of a factor when lateral force is applied. In some embodiments, lateral force and longitudinal forces can be combined.

Once the tubular string 120 is free, the operator may notice weight drop or upward axial movement of the tubular string 120 as upward tension force is continuously applied to the downhole assembly 200. Although the tension force is continuously applied, the magnitude of the force can vary. Typically, the tension force ranges from about 5% of maximum allowable overpull up to about 100% during operation. The magnitude of overpull force can depend on factors such as drill pipe size and grade, mud weight corresponding to buoyancy, drill string weight, and friction. In some embodiments, the maximum allowable overpull force is up to about 200,000 pounds (lbs.) for a 5-inch diameter drill pipe. Accordingly, the tension force ranges from about 10,000 lbs. to about 200,000 lbs.

After the tubular string 120 is freed from being stuck, the shock generating member 400 is deactivated. Downward hydraulic pressure can be increased to shear the second ball 460 and dispose the second ball 460 away from the second ball seat 414. In some embodiments, polyurethane balls may not withstand an increase in hydraulic pressure up to about 4,000 pounds per square inch (psi) and can shear through the second ball seat 414. In other embodiments, magnesium balls can be dissolved using a solvent. Once the second ball 460 is sheared, the spring 432 exerting elastic force can push the second mandrel 410 upwardly axially relative to the second housing 430. As the second mandrel 410 is pushed away, the shock pad 450 returns to its deactivated position inside the second housing 430. In other embodiments, deactivation of the shock generating member 400 can be achieved by other methods known in the art, such as dropping another ball or a dart, utilizing RFID tags, or providing pressure impulse from pumps located at the surface. In some embodiments, the activation and deactivation of the shock generating member 400 can be achieved multiple times.

As the shock generating member 400 is deactivated, the shock generating member 400 no longer exhibits laterally lifting force. No shocks are generated, and the shock generating member 400 exhibits smooth rotation against the wall of the wellbore 110.

In some embodiments, after deactivating the shock generating member 400, the entire tubular string is pulled out from the wellbore while the torque disconnecting member 300 is still in the unlocked position. The sheared shear pins 354 can then be replaced with new ones.

In other embodiments, the torque disconnecting member 300 can return to the locked position after deactivating the shock generating member 400 such that normal drilling activities can resume. After the shock generating member 400 is deactivated, the torque disconnecting member 300 can return to its initial locked position. Downward hydraulic pressure can be increased to shear the first ball 360 and dispose the first ball 360 away from the first ball seat 352. In some embodiments, polyurethane balls may not withstand an increase in hydraulic pressure and can shear through the first ball seat 352. In other embodiments, magnesium balls can be dissolved using a solvent. Still in other embodiments, spring-loaded mechanisms or electromechanical motors commonly used in the art can be used for unlocking and locking the torque disconnecting member 300. Once the first ball 360 is sheared, downward compression force from the surface is applied to push the first mandrel 310 downwardly axially relative to the first housing 330 until the corresponding compression faces 324, 344 are in contact. As the first mandrel 310 is pushed downwards, the corresponding torque transmission profile sections 312, 332 are reengaged. Because the first ball 360 is sheared, the locking mechanism 350 is able to reengage the first mandrel 310 such that the axial movement of the locking mechanism 350 is in concert with the first mandrel 310. The corresponding tension profiles 320, 340 are disengaged. The corresponding stop profiles 318, 338 are disengaged. In other embodiments, locking the torque disconnecting member 300 can be achieved by other methods known in the art, such as dropping another ball or a dart, utilizing RFID tags, or providing pressure impulse from pumps located at the surface. In some embodiments, the locking and unlocking of the torque disconnecting member 300 can be achieved multiple times. From an operational standpoint, the locking of the torque disconnecting member 300 is achieved by lowering the entire tubular string 120 to the bottom of the wellbore 110, pushing downwards the drill bit of the bottom hole assembly 130 against the formation, and transmitting a locking signal to the built-in electronic device for physical locking of the torque disconnecting member 300.

In some embodiments, more than one stuck pipe event can be encountered as the tubular string 120 is moving within the wellbore 110. Multiple torque disconnecting members 300 can be used in one bottom hole assembly 130. Multiple shock generating members 400 can also be used in one bottom hole assembly 130. Multiple torque disconnecting members 300 in such setting can be operated by first unlocking the downward-most torque disconnecting member 300 to observe whether the upper portion of the tubular string 120 is able to rotate. If the upper portion of the tubular string 120 is not able to rotate, the second downward-most torque disconnecting member 300 is unlocked, and so on, until the upper portion of the tubular string 120 is able to rotate.

In some embodiments, the downhole assembly 200 can be utilized as a part of a fishing assembly. In cases where a stuck pipe is disconnected and left downhole (the disconnected stuck pipe commonly referred to as a "fish"), the fishing assembly is operable to connect to the fish. Once the fishing assembly and the fish are connected, the shock generating member 400 of the downhole assembly 200 can be activated to free the fish. The connection between the fishing assembly and the fish can be performed by known methods in the art, for example, by attaching an overshoot tool over the fish.

In an example of operation, the downhole assembly 200 is positioned near a potential stuck point 140. Upon encountering a stuck pipe event, the operator initiates the unlocking sequence of the torque disconnecting member 300. The first ball 360 is placed on the first ball seat 352 and downhole hydraulic pressure is applied. The locking mechanism 350 engaged with the first mandrel 310 moves downhole relative to the first housing 330 until the locking mechanism 350 disengages the first mandrel 310. Uphole tension is applied to pull out a portion of the first mandrel 310 relative to the first housing 330 until the first mandrel stop profile 318 contacts the first housing stop profile 338, disengaging the mandrel torque transmission section profile 312 from the housing torque transmission section profile 332. While tension is continuously applied and the torque disconnecting member 300 is unlocked, the operator initiates the activation sequence of the shock generating member 400. The second ball 460 is placed on the second ball seat 414 and downhole hydraulic pressure is applied to compress the spring 432 and to downwardly move the second mandrel 410 relative to the second housing 430. The downhole movement of the second mandrel 410 enables the shock pad 450 to extend laterally. Downhole hydraulic pressure is continuously applied to keep the shock pad 450 in the extended position. The operator rotates the shock generating member 400, while parts of the torque disconnecting member 300 are stationary, to generate lateral shocks against the proximate wellbore 110 wall to free the stuck tubular string 120. Once the tubular string 120 is free, the shock generating member 400 is deactivated and the torque disconnecting member 300 is set to the locked position to resume normal drilling activities.

Figure 7:
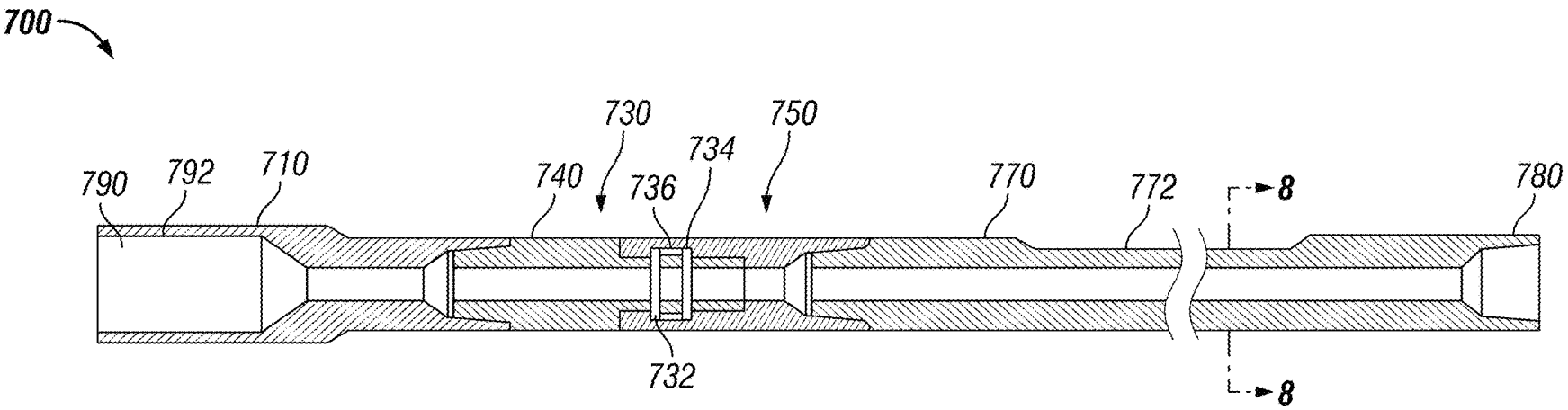
FIG. 7 is a side cross-sectional view of a fishing assembly, in accordance with an embodiment of this disclosure.

Referring now to FIG. 7, a fishing assembly 700 is shown. The fishing assembly 700 includes a fishing member 710, a swivel member 730, and an imbalanced member 770. The imbalanced member 770 is positioned uphole of the swivel member 730. The swivel member 730 is positioned uphole of the fishing member 710. The imbalanced member 770 is coupled to the swivel member 730 typically using standard API connections known in the art. The swivel member 730 is coupled to the fishing member 710 using standard API connections known in the art. A tubular string (not shown) can be connected uphole the fishing assembly 700 via connection 780. Alternately, the fishing assembly 700 is a wireline tool, a coiled tubing tool, or a part of a casing. The fish (that is, the disconnected downhole stuck tubular string, not shown) can be connected downhole the fishing assembly 700 via connection 790. Connection 790 includes a catching surface 792 to engage the fish. The catching surface 792 engages the exterior of the fish using means such as a grapple. In other embodiments, the engagement between the fishing assembly 700 and the fish can be achieved by an overshoot tool or a spear assembly, by connecting the dart left in the fish, or by using standard API connections known in the art. The fishing member 710 is operable to transfer axial and lateral loads to the fish. In some embodiments, the fishing member 710 can circulate through the fish.

In some embodiments, the fishing assembly 700 can be positioned within the stuck bottom hole assembly (not shown) using a wireline, an s-line, or a coiled tubing. In other embodiments, the fishing assembly 700 can be positioned within the stuck bottom hole assembly thrown in as a dart. The fishing assembly 700 can be positioned axially at the stuck point within the bottom hole assembly. Lateral vibration can be induced via the imbalanced member 770 at the stuck point within the bottom hole assembly, where shocks are transmitted to the immediate exterior of the stuck bottom hole assembly to free the bottom hole assembly. This way, it is no longer a requirement to sever the drill string. This way, it is no longer a requirement to undergo a fishing operation.

In some embodiments, an additional component can be connected between the fishing member 710 and the swivel member 730. Non-limiting examples of the additional component include a circulation valve, an axial jar with or without an accelerator, a pipe, and a drill collar. Such additional component can be used to increase the chances to engage the fish. Such additional component can be used to provide a disengaging feature. Such additional component can be used to change the downhole environment. Such additional component can be used to accelerate lateral shocks generated by the imbalanced member 770 uphole the swivel member 730. Such additional component can be used to obtain or read data (for example, data related to axial vibrations, lateral vibrations, RPM, pressure, and temperature) during operation.

The swivel member 730 includes a downhole swivel housing 740 and an uphole swivel housing 750. The downhole swivel housing 740 and the uphole swivel housing 750 are coupled via at least one bearing. FIG. 7 shows two bearings 732, 734 to couple the downhole swivel housing 740 and the uphole swivel housing 750. Torque can be transmitted from the surface using surface torque equipment (not shown) downwards through an uphole tubular string and further downwards through the imbalanced member 770. Torque is transmitted further downwards from the imbalanced member 770 to the uphole swivel housing 750. The existence of the bearings 732, 734 disallows torque to be transmitted from the uphole swivel housing 750 to the downhole swivel housing 740. In some embodiments, the swivel member 730 requires activation to disallow torque to be transmitted from the uphole swivel housing 750 to the downhole swivel housing 740. The activation can be achieved by methods known in the art, such as dropping a dart, dropping a ported dart, utilizing RFID tags, or providing pressure impulse from pumps located at the surface. Darts include rubber tails to assist in pumping the darts down the tubular string. Darts are typically used in non-vertical wells, preferably horizontal wells, when gravity becomes less a factor. RFID tags are microchips built inside a carrier, typically in forms of plastic spheres. The swivel member 730 can include a built-in electronic device including a power source, electronics, an electromechanical actuator, and a wireless receiver. The wireless receiver detects the RFID tag as the tag passes the receiver. As the tag is detected, the electronics subsequently respond and transmit signals to the electromechanical actuator to activate or deactivate the swivel member 730.

While torque is not transmitted downhole the uphole swivel housing 750 due to the bearings 732, 734, tension load can be transmitted from the uphole swivel housing 750 through the downhole swivel housing 740 via tension transmission profile 736. Tension load is transmitted further downwards from the downhole swivel housing 740 through the fishing member 710 and further downwards through the fish. As shown in FIG. 7, the bearings 732, 734 are positioned on each edge of the tension transmission profile 736 allowing axial movement of the fishing assembly 700 and the fish as a whole.

Figure 8:
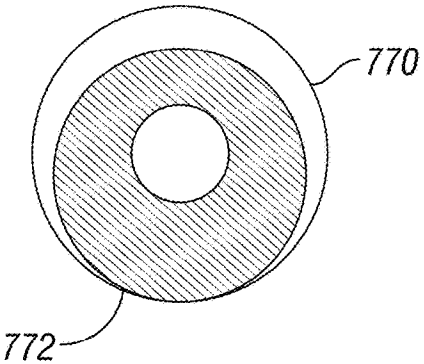
FIG. 8 is a front cross-sectional view of an imbalanced member shown in FIG. 7, taken along line 8-8.

The imbalanced member 770 includes an imbalanced profile 772. As shown in FIG. 8, the imbalanced profile 772 has a cross-sectional center of gravity off-centered relative to the longitudinal axis. In other embodiments, the imbalanced member 770 may include a pad laterally extended out from the nominal outside diameter of the imbalanced member 770, similar to the shock pad 450 of the shock generating member 400 of the downhole assembly 200. The pad can be machined, or assembled or welded onto the imbalanced member 770.

While the imbalanced member 770 is rotating, the imbalanced profile 772 creates a shock that transmits to the engaged fish. In some embodiments, the magnitude of force generated by the imbalanced profile 772 ranges from about 20 times gravitational force to about 30 times gravitational force. In other embodiments, the magnitude of force generated by the imbalanced profile 772 ranges from about 10 times gravitational force to about 50 times gravitational force. Still in other embodiments, the magnitude of force generated by the imbalanced profile 772 ranges from about 5 times gravitational force to about 100 times gravitational force. In some embodiments, the imbalanced member 770 rotates in a rate ranging from about 60 RPM to about 180 RPM. In other embodiments, the imbalanced member 770 rotates in a rate ranging from about 50 RPM to about 240 RPM. Still in other embodiments, the imbalanced member 770 rotates in a rate ranging from about 30 RPM to about 360 RPM. Shocks generated by the imbalanced member 770 travel away from the source in both axial directions: upward to the surface (if mechanically connected to the surface) and downward to the fish. In some embodiments, these periodic shocks can resonate over the entire tubular string such that at some distances away from the fishing assembly 700, more than one shock per rotation can be observed. Resonance frequency of the fishing assembly 700 can be calculated using software. In other embodiments, these periodic shocks can trigger the tubular string to experience and exhibit conditions known as forward, backward, or chaotic whirls. Fluid friction, radial clearance, and rotation speed can be controlled to create an environment to produce such whirls. Still in other embodiments, lateral forces ranging from about 30 times to about 40 times gravitational force can be observed near the stuck point. Yet in other embodiments, these periodic shocks generate vibratory forces that travel towards the stuck point. In some embodiments, the fishing assembly 700 does not require fluid flow to generate shocks.

Lateral force, as opposed to a longitudinal force such as jarring or pulling force, created by the imbalanced member 770 applies directly against differentially stuck force that is laterally pushing the pipe to make contact with the proximate wellbore wall at the stuck point. Friction between the fish and the wellbore wall at the stuck point becomes less of a factor when lateral force is applied. In some embodiments, lateral force and longitudinal forces can be combined.

Once the fish is free, the operator may notice weight drop or upward axial movement of the tubular string as upward tension force is continuously applied to the fishing assembly 700. Although the tension force is continuously applied, the magnitude of the force can vary. Typically, the tension force ranges from about 5% of maximum allowable overpull up to about 100% during operation. The magnitude of overpull force can depend on factors such as drill pipe size and grade, mud weight corresponding to buoyancy, drill string weight, and friction. In some embodiments, the maximum allowable overpull force is up to about 200,000 lbs. for a 5-inch diameter drill pipe. Accordingly, the tension force ranges from about 10,000 lbs. to about 200,000 lbs. After the fish is freed from being stuck, rotation can be ceased to ensure no shocks are generated, and the entire fishing assembly 700 engaged with the fish can be pulled out from the wellbore.

In an example of operation, upon encountering a stuck pipe event, the stuck pipe is severed near and uphole the stuck point. Any drilling assembly uphole the severed stuck pipe (that is, the fish) is removed from the wellbore. The fishing assembly 700 is positioned to engage the fish. The fishing member 710 may engage the fish by landing on top of the fish and applying weight to engage grapples or spears either from the exterior or interior of the fish. Once the fishing member 710 and the fish are engaged, uphole tension is applied to the fishing assembly 700 to confirm proper engagement and axial force transmission. Optionally, the swivel member 730 is activated if it requires activation. Once proper engagement is established, torque is transmitted downward through the imbalanced member 770 and further downward through the uphole swivel housing 750. In some embodiments, torque can be delivered by a top drive system or a rotary table used in conventional drilling operations but uncommon in fishing operations. Optionally, a mud motor can be run to provide torque to the fishing assembly 700 while pumping fluid across the mud motor. Optionally, a downhole electric motor can be used to provide torque, which can be powered from the surface via electric connection or by a power source embedded in the fishing assembly 700 downhole. The operator rotates the imbalanced member 770 and the uphole swivel housing 750, while the downhole swivel housing 740, the fishing member 710 and the fish are stationary, to generate lateral shocks against the proximate wellbore wall to free the fish. Once the fish is free, the fishing assembly 700 engaged with the fish is retrieved to the surface. Normal drilling activities can be resumed.

This disclosure is illustrated by the following examples, which are presented for illustrative purposes only, and are not intended as limiting the scope of the invention which is defined by the appended claims.

EXAMPLES

Finite element analysis (FEA) was conducted to investigate the mechanical movement and behavior of a stuck pipe. The stuck pipe was subject to lateral accelerations corresponding to the shocks generated by either the shock generating member 400 or the imbalanced member 770. The stuck pipe was also subject to a laterally pulling force corresponding to the differential sticking force, which was set to hold a section of the stuck pipe against the wellbore wall.

The FEA analysis simulated a stuck pipe having a section of about 20 feet subject to a constant differential sticking force of about 1,000,000 lbs. Mechanical properties of the simulated stuck pipe were set according to the American Iron and Steel Institute (AISI) 4145H modified steel (4145H MOD) standard. The inner wall of the simulated wellbore was set as a constraint to avoid the wellbore from vibrating. The simulated shocks were set corresponding to a magnitude of 20 times gravitational force at 10 hertz (Hz). The inner diameter of the simulated wellbore was set corresponding to about 8.5 inches. The inner diameter of the simulated stuck pipe was set corresponding to about 2.625 inches. The outer diameter of the simulated stuck pipe was set corresponding to about 6.75 inches.

Figure 9:
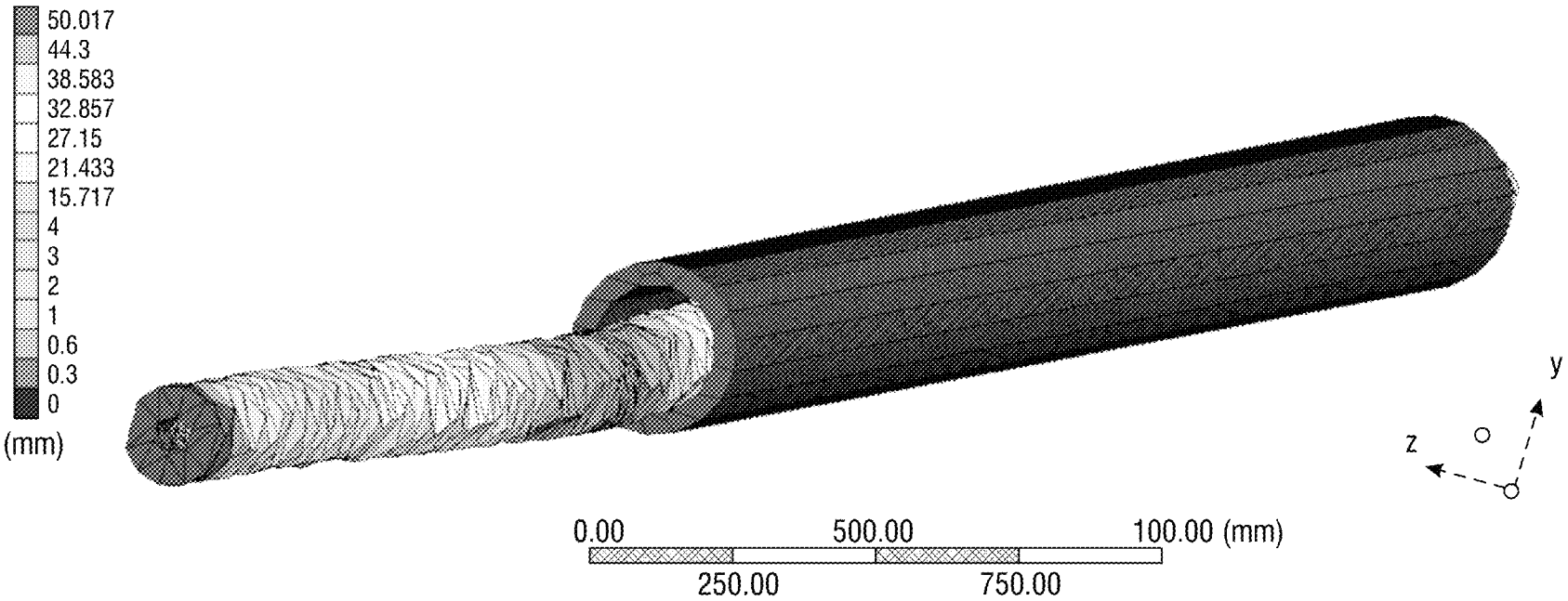
FIG. 9 is a graphical representation of a stuck pipe. The stuck pipe is subject to shocks generated by either the shock generating member or the imbalanced member. The stuck pipe is also subject to a differential sticking force.

FIG. 9 shows an FEA dynamic simulation using software provided by ANSYS, Inc. (Canonsburg, Pa.). The vertical gradient represents displacement in millimeters (mm). The horizontal scale bar represents length in mm. The maximum lateral movement of the stuck pipe amounted to about 50 mm, corresponding to shocks having a magnitude of 20 times gravitational force at 10 Hz. The lateral movement of the simulated stuck pipe was attenuated as the pipe entered into the simulated wellbore. The results are plotted in FIG. 10.

Figure 10:
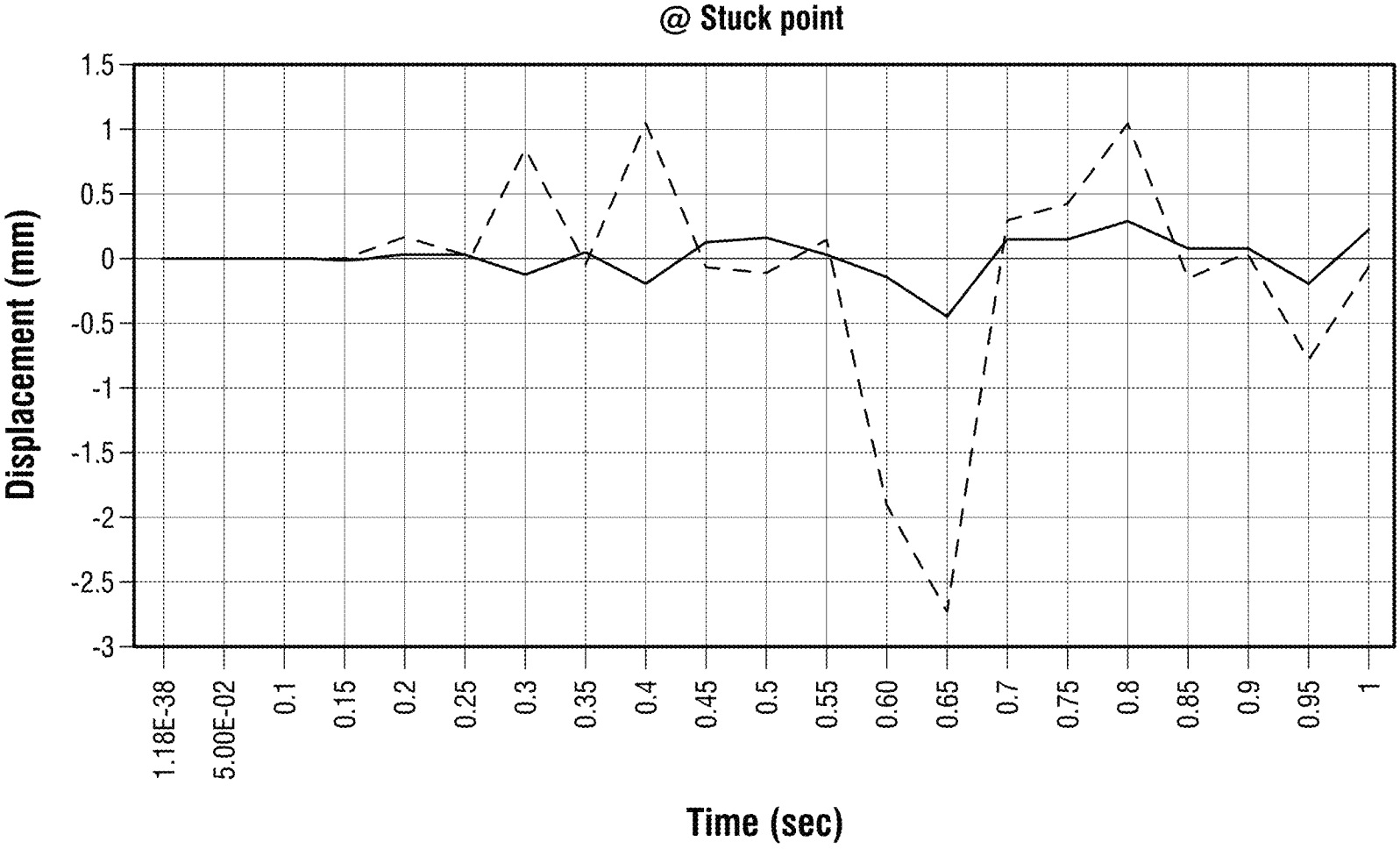
FIG. 10 is a graphical representation showing lateral movement of the stuck pipe shown in FIG. 9 at a stuck point over time.

FIG. 10 shows a graph showing lateral movement of the simulated stuck pipe at the stuck point in mm over time. The vertical axis represents displacement in mm. The horizontal axis represents time in seconds. The solid line represents displacement of the stuck pipe (subject to simulated shocks) over time along the x-axis (that is, the direction out of page) shown in FIG. 9. The dotted line represents displacement of the stuck pipe (subject to simulated shocks) over time along the y-axis shown in FIG. 9. As shown in FIG. 10, lateral movement of greater than about 2 mm was observed.

Embodiments of this disclosure can therefore enable the tubular string in wellbore to mitigate potential and actual stuck pipe problems. The downhole assembly 200 and the fishing assembly 700 are used for improved drilling performance. The systems and methods of this disclosure can reduce the time and costs associated with stuck pipes compared to currently available remedial actions and interventions.

Embodiments of the disclosure described are well adapted to carry out the objects and attain the ends and advantages mentioned, as well as others that are inherent. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for moving a tubular string within a wellbore during a stuck pipe event, the system comprising:

a torque disconnecting member, the torque disconnecting member comprising:
- a first mandrel; and
- a first housing,
- where the first mandrel is coupled to the first housing and is movable axially relative to the first housing such that the first mandrel is rotationally coupled to the first housing in a locking position and the first mandrel is rotative relative to the first housing in an unlocking position; and a shock generating member, the shock generating member coupled to the torque disconnecting member, the shock generating member comprising:
- a second mandrel;
- a second housing; and
- a shock pad,
- where the second housing is rotationally coupled to the first mandrel,
- where the second mandrel is coupled to the second housing, is movable axially relative to the second housing, and is further coupled to the shock pad such that the second mandrel engages the shock pad to extend outwardly laterally in an activated position from a deactivated position, the deactivated position having the shock pad retracted inside the second housing.

2. The system of claim 1, where the torque disconnecting member further comprises a locking mechanism including a shear pin, the shear pin configured to rotationally couple the first mandrel and the first housing in the locking position.

3. The system of claim 2, where the locking mechanism further comprises a first ball seat configured to position a first ball on the first ball seat while applying downward hydraulic pressure through the torque disconnecting member to shear the shear pin and to disengage the first mandrel from the locking mechanism.

4. The system of claim 1, where the first mandrel includes a mandrel tension profile and the first housing includes a housing tension profile corresponding to the mandrel tension profile, configured to limit upward axial movement of the first mandrel relative to the first housing as upward tension force is applied to the first mandrel maintaining the torque disconnecting member in the locking position operable to transmit upward tension force from the first mandrel to the first housing.

5. The system of claim 4, where the mandrel tension profile is collapsible allowing the mandrel tension profile to upwardly axially squeeze and pass through the housing tension profile such that the torque disconnecting member is in the unlocking position.

6. The system of claim 1, where the first mandrel includes a mandrel torque transmission profile section having polygonal cross-section and the first housing includes a housing torque transmission profile section having polygonal cross-section corresponding to the mandrel torque transmission profile section, configured to rotationally couple the first mandrel and the first housing in the locking position when engaged, and where the first mandrel moves upwardly axially relative to the first housing disengaging the mandrel torque transmission profile section and the housing torque transmission profile section such that the torque disconnecting member is in the unlocking position.

7. The system of claim 6, where the first mandrel includes a mandrel stop profile and the first housing includes a housing stop profile corresponding to the mandrel stop profile, configured to limit upward axial movement of the first mandrel relative to the first housing in the unlocking position operable to transmit upward tension force from the first mandrel to the first housing.

8. The system of claim 1, where the shock generating member further comprising:

a spring, where the spring engages with the second mandrel and the second housing and is operable to elastically maintain the deactivated position; and a second ball seat;

where the second ball seat is configured to position a second ball on the second ball seat while applying downward hydraulic pressure through the shock generating member to move the second mandrel downwardly axially relative to the second housing such that the shock generating member is in the activated position.

9. The system of claim 1, where the shock pad in the activated position has a graduate elevation face and a steep elevation face, where the graduate elevation face is configured to contact a proximate side of a wellbore wall as the shock generating member is rotating, the graduate elevation face laterally lifting away the shock generating member from the contacting proximate side of the wellbore wall, the shock generating member laterally dropping onto the proximate side of the wellbore wall generating a shock as the graduate elevation face is no longer contacting the proximate side of the wellbore.

10. A method for moving a tubular string within a wellbore during a stuck pipe event, the method comprising the steps of:

unlocking a torque disconnecting member, the torque disconnecting member comprising:

a first mandrel; and a first housing, where the first mandrel is coupled to the first housing and is movable axially relative to the first housing, and where the first mandrel is rotative relative to the first housing from a locking position, the locking position having the first mandrel rotationally coupled with the first housing; and activating a shock generating member, the shock generating member coupled to the torque disconnecting member, the shock generating member comprising:

a second mandrel;

a second housing; and a shock pad, where the second housing is rotationally coupled to the first mandrel, where the second mandrel is coupled to the second housing and is movable axially relative to the second housing, and where the second mandrel is coupled to the shock pad and engages the shock pad to extend outwardly laterally from a deactivated position, the deactivated position having the shock pad retracted inside the second housing.

11. The method of claim 10, in the unlocking step, the torque disconnecting member further comprises a locking mechanism including a shear pin, where the shear pin rotationally couples the first mandrel and the first housing in the locking position.

12. The method of claim 11, in the unlocking step, the locking mechanism further comprises a first ball seat, where a first ball is positioned on the first ball seat and downward hydraulic pressure is applied through the torque disconnecting member to shear the shear pin and to disengage the first mandrel from the locking mechanism.

13. The method of claim 10, in the unlocking step, the first mandrel includes a mandrel tension profile and the first housing includes a housing tension profile corresponding to the mandrel tension profile, limiting upward axial movement of the first mandrel relative to the first housing as upward tension force is applied to the first mandrel and transmitting upward tension force from the first mandrel to the first housing.

14. The method of claim 13, in the unlocking step, the mandrel tension profile is collapsible allowing the mandrel tension profile to upwardly axially squeeze and pass through the housing tension profile such that the torque disconnecting member is in an unlocking position.

15. The method of claim 10, in the unlocking step, the first mandrel includes a mandrel torque transmission profile section having polygonal cross-section and the first housing includes a housing torque transmission profile section having polygonal cross-section corresponding to the mandrel torque transmission profile section, configured to rotationally couple the first mandrel and the first housing in the locking position when engaged, where the first mandrel moves upwardly axially relative to the first housing disengaging the mandrel torque transmission profile section and the housing torque transmission profile section such that the torque disconnecting member is an the unlocking position.

16. The method of claim 15, in the unlocking step, the first mandrel includes a mandrel stop profile and the first housing includes a housing stop profile corresponding to the mandrel stop profile, limiting upward axial movement of the first mandrel relative to the first housing as the torque disconnecting member is unlocked, operable to transmit upward tension force from the first mandrel to the first housing.

17. The method of claim 10, in the activating step, the shock generating member further comprising:

a spring, where the spring engages with the second mandrel and the second housing and is operable to elastically maintain the deactivated position; and a second ball seat;

where a second ball is positioned on the second ball seat and downward hydraulic pressure is applied through the shock generating member to move the second mandrel downwardly axially relative to the second housing.

18. The method of claim 10, further comprising the step of:

rotating the activated shock generating member to generate a shock, where the shock pad has a graduate elevation face and a steep elevation face, where the graduate elevation face contacts a proximate side of a wellbore wall as the activated shock generating member is rotating, the graduate elevation face laterally lifting away the shock generating member from the contacting proximate side of the wellbore wall, the shock generating member laterally dropping onto the proximate side of the wellbore wall as the graduate elevation face is no longer contacting the proximate side of the wellbore.

* * * * *